US009974363B2

(12) United States Patent
Bolen

(10) Patent No.: US 9,974,363 B2
(45) Date of Patent: May 22, 2018

(54) BUTTON ADAPTER FASTENING SYSTEM

(71) Applicant: Robert Bolen, Bethesda, MD (US)

(72) Inventor: Robert Bolen, Bethesda, MD (US)

(73) Assignee: Robert Bolen, Bethesda, MD (US)

( * ) Notice: Subject to any disclaimer, the term of this patent is extended or adjusted under 35 U.S.C. 154(b) by 133 days.

(21) Appl. No.: 14/857,132

(22) Filed: Sep. 17, 2015

(65) Prior Publication Data

US 2016/0000189 A1 Jan. 7, 2016

Related U.S. Application Data

(63) Continuation-in-part of application No. 14/523,844, filed on Oct. 25, 2014, now Pat. No. 9,713,354.

(60) Provisional application No. 61/906,364, filed on Nov. 19, 2013.

(51) Int. Cl.

| | |
|---|---|
| ***A44B 1/08*** | (2006.01) |
| ***A41F 1/00*** | (2006.01) |
| ***A44B 1/30*** | (2006.01) |

(52) U.S. Cl.

CPC ..... *A44B 1/08* (2013.01); *A41F 1/00* (2013.01); *A41F 1/002* (2013.01); *A44B 1/30* (2013.01); *A44D 2203/00* (2013.01); *Y10T 24/45257* (2015.01)

(58) Field of Classification Search

CPC ... A41F 1/00; A41F 1/002; A44B 1/30; A44B 17/0064; A44B 1/08; Y10T 24/45257; Y10T 24/45089; Y10T 24/4578; A44D 2203/00

See application file for complete search history.

(56) References Cited

U.S. PATENT DOCUMENTS

| | | | | |
|---|---|---|---|---|
| 1,485,990 | A * | 3/1924 | Moore | F16B 21/06 24/580.1 |
| 3,141,216 | A * | 7/1964 | Haskell | A41F 1/002 24/303 |
| 8,631,517 | B1 * | 1/2014 | Blakely | A44B 1/28 2/266 |
| 9,220,321 | B1 * | 12/2015 | Sun | A44B 1/04 |
| 9,307,806 | B1 * | 4/2016 | Dorman | A44B 1/14 |
| 2005/0177985 | A1 * | 8/2005 | Sjoquist | A41F 1/002 24/104 |
| 2012/0252965 | A1 * | 10/2012 | Coffman | C08L 59/02 524/566 |
| 2013/0232729 | A1 * | 9/2013 | Abadi | A44B 6/00 24/66.4 |
| 2014/0259553 | A1 * | 9/2014 | Sjoquist | A41F 1/002 24/303 |

(Continued)

*Primary Examiner* — Robert Sandy
*Assistant Examiner* — Louis A Mercado
(74) *Attorney, Agent, or Firm* — Duane Morris LLP

(57) ABSTRACT

Various embodiments of a fastening system that either attaches to existing buttons or attaches directly to an article of clothing. In preferred embodiments, the fastening system has a first portion that attaches to a button hole or a first part of the article and a second portion that attaches to a button or second part of the article. The first portion and second portion detachably attach to each other by means of a twist-lock, magnetic mechanism, or some other attachment mechanism. Alternatively, the fastening system can be built directly into an article without augmenting an existing button and button-hole fastener.

5 Claims, 15 Drawing Sheets

(56) References Cited

U.S. PATENT DOCUMENTS

2016/0360810 A1* 12/2016 Lim ..... A41F 1/002
2017/0006974 A1* 1/2017 Zur ..... A41F 1/002

* cited by examiner

BUTTON ADAPTER FASTENING SYSTEM

CROSS-REFERENCE TO RELATED APPLICATIONS

The present application is a continuation in part of and claims priority to non-provisional U.S. patent application Ser. No. 14/523,844 entitled "Twist-Lock Button" filed Oct. 25, 2014 now U.S. Pat. No. 9,713,354 and which, in turn, claims priority from provisional application No. 61/906,364 entitled "Twist-Lock Button" filed Nov. 19, 2013, the contents of which are incorporated by reference herein in their entirety.

FIELD OF THE INVENTION

The present invention generally relates to fastening systems. Specifically, this invention relates to various embodiments of a fastening system that either attaches to existing buttons or attaches directly to an article of clothing. In preferred embodiments of the present invention, the fastening system has a first portion that attaches to a button hole or a first part of the article and a second portion that attaches to a button or second part of the article. The first portion and second portion detachably attach to each other by means of a twist-lock, magnetic mechanism, or some other attachment mechanism. Alternatively, the fastening system can be built directly into an article without augmenting an existing button and button-hole fastener.

BACKGROUND OF THE INVENTION

Fasteners are an important part of sporting. Particularly in extreme applications, such as skiing, snowboarding, sailing, climbing, skydiving, bungee jumping, mountaineering, etc., having reliable fasteners for clothing and equipment can mean the difference between life and death. However, standard fasteners of the industry all have some kind of weakness that makes them less than ideal. Snaps, although great for party shirts, tend to come undone under heavy loads and high winds. Buttons pop off or break after prolonged use or in extreme conditions. Zippers are notorious for jamming at the most inopportune moments. Hook-and-loop fasteners tend to wear out over time.

In addition, standard fasteners are often difficult for people who have difficulty with fine motor skills. Young children, stroke recoverees, people with cerebral palsy, ALS, Parkinson's disease, injured veterans, people with arthritis, and amputees can find it difficult to manipulate buttons, snaps, zippers and hook and loop.

Thus there is a need in the industry for a fastener that is durable, secure, and immune to jamming, while still being easy to use for all people of varying abilities. These and other features and advantages of the present invention will be explained and will become obvious to one skilled in the art through the summary of the invention that follows.

SUMMARY OF THE INVENTION

Figure 1:
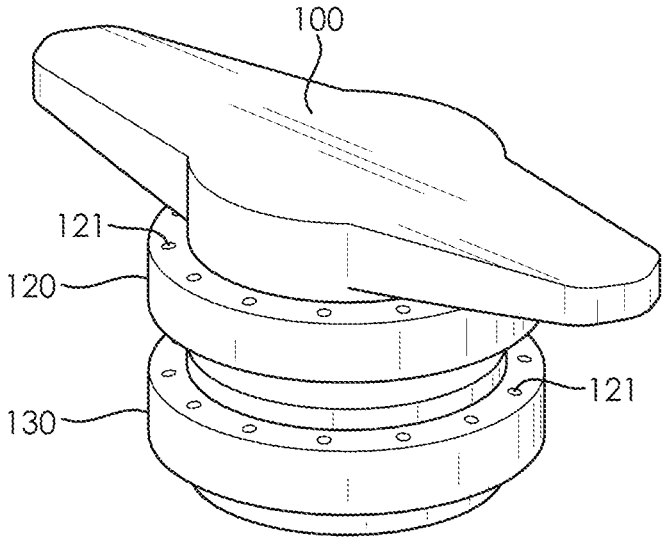
FIG. 1 shows a perspective view of an illustrative embodiment of a twist-lock button, in accordance with an embodiment of the present invention.

Accordingly, it is an object of the present invention to provide a twist-lock fastener which is durable, secure, aesthetically appealing, and immune to jamming, while still being easy to use for people of varying abilities.

According to an embodiment of the present invention, a twist-lock fastener comprises a handle comprising a grip portion configured to be rotatable by a human hand; a negative; an attachment means on the negative for attaching the negative to an article of clothing or equipment; a locking portion; and a cylindrical interior cavity with an interior wall and an opening at one end; wherein the handle and the negative mate together by the locking portion being received into the interior cavity and the locking portion and the interior cavity rotate relative to each other into a locked position.

According to an embodiment of the present invention, the locking portion comprises a cylindrical extension.

According to an embodiment of the present invention, the locking portion further comprises a raised ridge extending from the base of the cylindrical extension and moving around the cylindrical extension as the raised ridge approaches the end opposite the base of the cylindrical extension and wherein the interior cavity is configured to engage with the raised ridge and rotate into a locked position.

According to an embodiment of the present invention, the attachment means comprises a plurality of thread holes.

According to an embodiment of the present invention, the attachment means further comprises a perimeter channel recessed into the negative, the perimeter channel formed by an interior sidewall and an exterior sidewall and a plurality of the thread holes passing through the bottom of the perimeter channel.

According to an embodiment of the present invention, the attachments means comprises a surface opposite the opening of the interior cavity for applying an adhesive.

According to an embodiment of the present invention, the attachment means comprises a button adaptor for attaching to an existing button on an article of clothing.

According to an embodiment of the present invention, the locking portion is integrally formed with the negative and the cylindrical interior cavity is formed into a portion of the handle.

According to an embodiment of the present invention, the locking portion is attached to the handle and the cylindrical interior cavity is formed into the negative.

According to an embodiment of the present invention, the locking portion attaches to the handle by a plurality of hooks which snap into matching grooves on a portion of the handle.

According to an embodiment of the present invention, the fastener further comprises a collar formed of a ring of material configured to allow the locking portion to pass through the collar and mate with the interior cavity.

According to an embodiment of the present invention, the collar comprises an attachment means for attaching the collar to an article of clothing or equipment.

According to an embodiment of the present invention, the attachment means comprises a plurality of thread holes.

According to an embodiment of the present invention, the attachment means further comprises a perimeter channel recessed into the collar, the perimeter channel formed by an interior sidewall and an exterior sidewall and a plurality of thread holes passing through the bottom of the perimeter channel.

According to an embodiment of the present invention, the handle rotatably attaches to the collar.

According to an embodiment of the present invention, the handle attaches to the collar by means of a plurality of hooks which pass through the collar and engage with the opposite side of the collar such that the collar and handle rotate freely relative to each other and the handle is retained upon the collar.

According to an embodiment of the present invention, an adapter for attaching a secondary fastener to a button, such as on an article of clothing comprises: a locking plate with a pass-through hole and a pass-through channel extending between the pass-through hole and an outside edge of the locking plate, wherein the locking plate has a plurality of locking channels passing perpendicularly through the locking plate, the locking channels configured to receive locking hooks; and a fastener negative configured to receive a fastener, the fastener negative having a plurality of locking hooks aligned with the locking channels of the locking plate, the locking hooks configured to extend through the locking plate and hold the locking plate flush against the fastener negative when in the locked position.

According to an embodiment of the present invention, the locking hooks pass through the locking channels in the locking plate by entering through a first surface of the locking plate and snapping into the locked position by the hooks being retained on a second surface of the locking plate.

According to an embodiment of the present invention, each of the locking channels are provided with an access passage running from an outside edge of the plate to the locking channel such that the locking hooks rotate into the locked position.

According to an embodiment of the present invention, a retaining nub is positioned between each the access passage and the adjoining the locking channel, wherein the retaining nub protrudes from the edge of the plate and allows the locking hooks to snap into the locked position and the retaining nub prevents the locking hooks from disengaging from the locked position.

According to an embodiment of the present invention, a fastening system for augmenting a button and buttonhole fastener comprises: a retaining piece; a first fastening part configured to attach to the retaining piece by a connecting shaft, said connecting shaft configured to pass through a hole in an article; a second fastening part configured to attach to a button sewn to an article; wherein said first fastening part and said second fastening part are configured to be removably attachable to each other.

According to an embodiment of the present invention, said first fastening part is a magnet.

According to an embodiment of the present invention, said second fastening part comprises a magnetic insert attached to the second fastening part by a magnetic insert attachment mechanism.

According to an embodiment of the present invention, said first fastening part attaches to said retaining piece by means of a bolt which forms the connecting shaft.

According to an embodiment of the present invention, said first fastening part is magnetic.

According to an embodiment of the present invention, said second fastening part comprises a magnetic insert.

According to an embodiment of the present invention, said second fastening part further comprises: a main body portion comprising: a cavity configured to fit onto a button, and an access slot passing through at least one side of the main body portion into the cavity; and a button adapter clip configured to fit into the access slot retaining a button within the cavity; wherein the magnetic insert is attached to the main body portion of the second fastening part.

According to an embodiment of the present invention, said magnetic insert is a magnet.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

The present invention generally relates to fastening systems. Specifically, this invention relates to a various embodiments of a fastening system that either attaches to existing buttons or attaches directly to an article of clothing. In preferred embodiments of the present invention, the fastening system has a first portion that attaches to a button hole or a first part of the article and a second portion that attaches to a button or second part of the article. The first portion and second portion detachably attach to each other by means of a twist-lock, magnetic mechanism, or some other attachment mechanism. Alternatively, the fastening system can be built directly into an article without augmenting an existing button and button-hole fastener.

According to an embodiment of the present invention, the fastening system has four primary parts. The first part is positioned over or through an attachment hole in an article, such as a button hole for example. This first part may be decorative, with the appearance of a button or snap. The first part may also have functional characteristics, such as a handle, knob, or grasp that can be used to manipulate the first piece to fasten and unfasten the fastening system. The second part is a fastener piece and contains a fastening mechanism such as a twist-lock, a magnetic fastener, a snap, a clasp, a button holder, or some other fastening system. The second part attaches to the first piece through the attachment hole, securing the first and second pieces to the article of clothing.

Alternatively, the second part is an extension of the first part which passes through the attachment hole and another attachment mechanism is used to secure the first and second parts to the article. For example, the first part may snap into a ring that is attached to the attachment hole and the second part extends through the attachment hole. According to an embodiment of the present invention, the first and second part are attached to an article and the second part is a fastener piece that passes through the attachment hold of the article.

The third part is a corresponding fastener piece that corresponds to the fastener of the second piece. If the fastener piece is a twist-lock, the corresponding fastener piece comprises a receiving portion for the twist-lock. If the fastener piece is a magnetic fastener, the corresponding fastener piece comprises a magnet or magnetic material. The second part and third part are configured to fasten to each other in a detachable manner. The third part attaches to the article directly by glue, sewing or any other means, or by attaching to a button on the article. The article may be an article of clothing, a bag, a piece of fabric, or any other item to be fastened to another item.

The fourth part is a button adaptor which may be a clip that slides under a button, between the button and the article it is attached to, and interfaces with the third part to attach the third part to the button. The button adaptor and the third part may take various embodiments to interface with each other and attach to a button. Some illustrative embodiments are described below.

Advantageously, embodiments of the present invention are convenient for young children, stroke recoverees, people with cerebral palsy, ALS, Parkinson's disease, injured veterans, people with arthritis, and amputees or others with disabilities that may make use of standard fasteners difficult. Given that embodiments of the present invention allow for ease of opening and closing the fastener, without jeopardizing the secure nature of the fastening created by the fastener, those persons enumerated above are provided a means for conveniently utilizing articles they may have been prevented from using previously.

Figure 2:
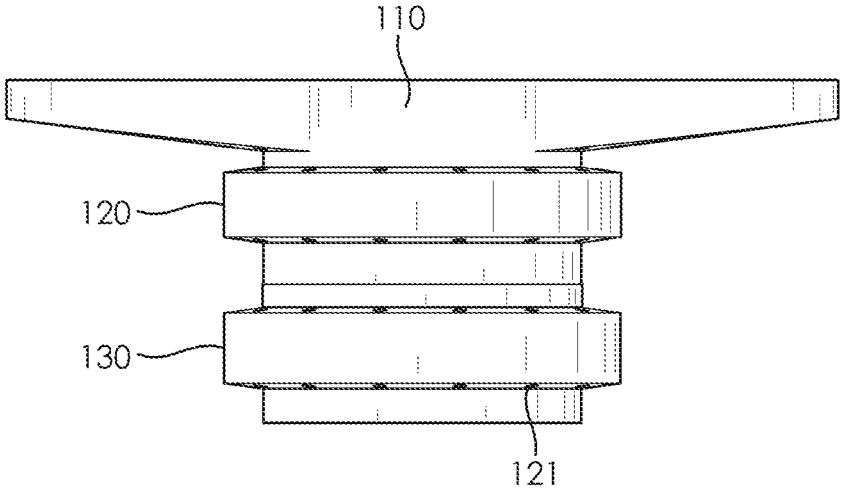
FIG. 2 shows a side view of an illustrative embodiment of a twist-lock button, in accordance with an embodiment of the present invention.

FIGS. 1-2 show views of a twist-lock button with the handle 110 engaged with both the collar 120 and the negative 130 in a locked position. FIG. 1 shows a perspective view of a twist-lock button and FIG. 2 shows a side view of a twist-lock button. According to an embodiment of the present invention shown in FIG. 1 and FIG. 2, a twist-lock button comprises three distinct elements: a handle 110, a collar 120, and a negative 130. In one embodiment of the present invention, the handle 110 and collar 120 may be combined into a single component, such that the handle 110 is retained upon the collar 120 in a manner that allows for movement of the handle between a locked and unlocked position without being removed from the collar 120 itself. The handle rotates freely within the collar 120, allowing it to be twisted as much as is required to obtain a secure friction fit. In this embodiment, the first part and the second part, or fastener piece, are combined together in the handle 110 and the collar 120 is used to attach the handle 110 to the attachment hole on the article. The corresponding fastener piece is included in the negative 130.

According to an embodiment of the present invention, both the collar 120 and the negative 130 each have a horizontal ridge around the outer circumference with thread holes 121 perpendicular to the direction of the ridge passing through each ridge from top to bottom. These holes 121 are designed to allow threads to pass through so that the collar 120 and the negative 130 can be sewn or attached to an article, such as a piece of fabric, sporting equipment (e.g., skiing equipment, sailing equipment) or other material that is intended to be removably secured to another article. An example of an article to be secured is a fly of a pair of pants. The negative 130 may be retained on an interior fly wall of the pants. Securing or retention of the negative 130 upon an article can be through any appropriate securing or retention means, such as riveting, sewing, tacking, adhesives, or any combination thereof. One of ordinary skill in the art would appreciate that there are numerous methods for securing a negative 130 on an article, and embodiments of the present invention are contemplated for use with any appropriate methods and/or means.

Figure 3:
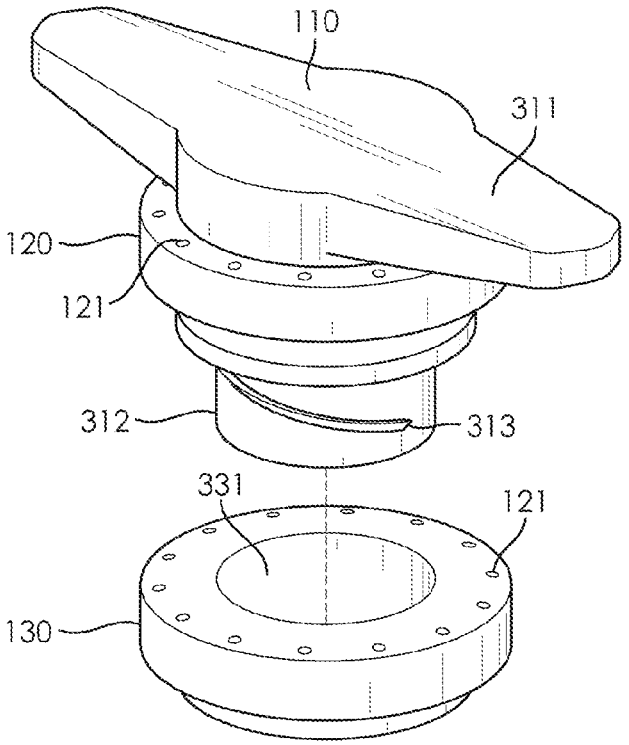
FIG. 3 shows a perspective view of an illustrative embodiment of a twist-lock button, in accordance with an embodiment of the present invention.
Figure 4:
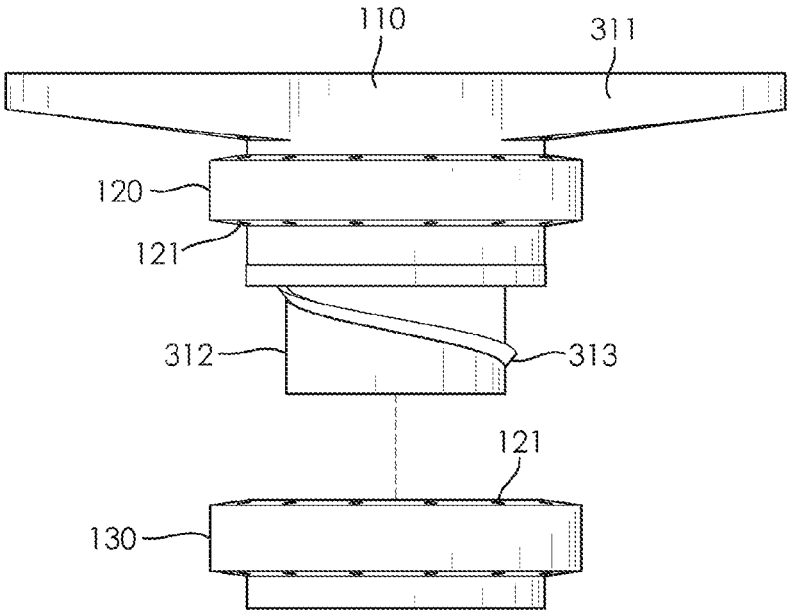
FIG. 4 shows a side view of an illustrative embodiment of a twist-lock button, in accordance with an embodiment of the present invention.

FIGS. 3-4 show a twist-lock button in an unlocked position, with the negative 130 separated from the collar 120 and the handle 110. FIGS. 3-4 also clearly demonstrates the grip portion 311 and locking portion 312 of the handle 110, as well as the interior cavity 331 of the negative 130. Referring now to FIG. 3, according to an embodiment of the present invention, the handle comprises two portions, a grip portion 311 and a locking portion 312. The grip portion 311 serves the purpose of the first part, described above and the locking portion 312 serves the purpose of the second part, or fastening piece. The grip portion 311 is provided such that a user may manipulate the grip portion 311 with ease to twist the handle 110. This allows the grip portion 311 to be utilized to move the locking portion 312 between a locked and an unlocked position. In a preferred embodiment, the grip portion 311 is a T-shape with wings extending from a central body, as shown in FIG. 3 to allow for convenient gripping of the handle 110 by a user. In other embodiments, the grip portion 311 may be rounded or otherwise formed without wings, providing a low-profile format that would prevent the handle 110 from being caught on other materials. One of ordinary skill in the art would appreciate that there are numerous shapes and forms for the handle 110, and embodiments of the present invention are contemplated for use with handles of any form or shape.

According to an embodiment of the present invention, the collar 120 is a circular component with walls forming an opening configured to receive the handle 110 through it, such that the locking portion 312 protrudes from one side of the collar while the handle protrudes from the other side. In one embodiment of the present invention, the collar 120 is configured to retain the handle within the opening such that the handle cannot be removed from the opening of the collar 120. In other embodiments, the handle may be removably attachable to the opening of the collar 120. In yet further embodiments, the opening of the collar 120 may simply allow the securing element of the handle to pass through without having any retention or securing capabilities built thereupon. According to one embodiment, the handle 110 passes through an attachment hole such as a button hole and attaches to the locking portion 312 on the other side of the button hole in a way that prevents the handle 110 from falling out of the attachment hole. This can be achieved without requiring the collar 120 to hold the handle.

According to an embodiment of the present invention, the negative 130 is a circular component with walls forming an interior cavity 331 configured to receive a locking portion 312 of the handle. The locking portion 312 extends from the handle through the collar 120 to fit into and engage with an interior cavity 331 of the negative 130. In a preferred embodiment of the present invention, the locking portion 312 of the handle 110 is a cylindrical element extending from one end of the handle. The locking portion 312 is further formed with an exterior ridge 313 extending perpendicularly from the cylindrical element, beginning at the base of the cylindrical element and wrapping around the perimeter of the cylindrical element while gradually approaching the end of the cylindrical element. The exterior ridge 313 is similar to the thread of a screw or bolt and operates similarly, engaging in a friction fit with a channel formed on the interior cavity 331 of the negative 130. In usage, the locking portion of the handle is inserted into the interior cavity 331 of the negative 130 and twisted in one direction (e.g., clockwise, counterclockwise) to engage the exterior ridge 313 with corresponding parts on the interior cavity 331 of the negative 130, thus locking the pieces together in a friction fit.

It should be understood that moving a twist-lock button from the locked position to an unlocked position simply requires rotation of the handle 110 in the opposite direction that was utilized to enter into the locked position. In a preferred embodiment, the rotation required to switch from locked to unlocked and vice versa would be 180 degrees from the locked or unlocked position. However, one of ordinary skill in the art would appreciate that locked and unlocked positions may be further or closer apart, requiring rotations of more than or less than 180 degrees to switch positions, and embodiments of the present invention are contemplated for use with any rotation suitable for moving between locked and unlocked positions, including, but not limited to, rotations of between 5 degrees and 360 degrees.

In an alternate embodiment of the present invention, the exterior ridge 313 interlocks with a corresponding ridge on the interior cavity 331 of the negative 130. In other words, rather than having a groove or channel that fits snugly around the raised ridge 313 of the locking portion 312, the negative 130 has a corresponding ridge which allows for significant slop between the locking portion 312 and the interior cavity 331 until the handle 110 is twisted, bringing the raised ridge 313 and corresponding ridge into contact with each other to form a secure friction fit. This has the advantage of providing ample room for lining up the locking portion 312 for proper engagement with the negative 130 without having to resort to the fine adjustments that would be required under tighter tolerances. In preferred embodiments, the handle is rotated 180 degrees to enter into a locked position. In other embodiments, any number of rotations may be utilized in order to enter into the locked position. One of ordinary skill in the art would appreciate that any number of rotations could be utilized.

In alternate embodiments, the exterior ridge 313 may be formed on the interior cavity 331 of the negative 130, while the corresponding channel is formed on the locking portion 312 of the handle 110. In still further embodiments, the system may utilize other locking means to allow for a twist-lock connection between the handle 110 and the negative 130. For instance, a pin and groove locking means may be utilized with one or more pins formed on the exterior surface of the locking portion of the handle and a "L", "J" or "U" shaped grooves are formed on an interior wall of the negative 130 such that the one or more pins can be received in the grooves and moved to a locking position by twisting the handle once the pin has reached the bottom of the groove. One of ordinary skill in the art would appreciate that there are numerous types of twist-lock means that could be utilized with embodiments of the present invention, and embodiments of the present invention are contemplated for use with any type of twist-lock means.

Although preferred embodiments of the present invention utilize a negative that is circular in nature, other embodiments may feature a negative that is of any shape. Additionally, other embodiments may include the locking portion incorporated into the negative and the interior cavity for receiving the locking portion incorporated into the handle. One of ordinary skill in the art would appreciate that the same securing features could be utilized with the locking portion and interior cavity attached to either the handle or the negative.

Figure 5:
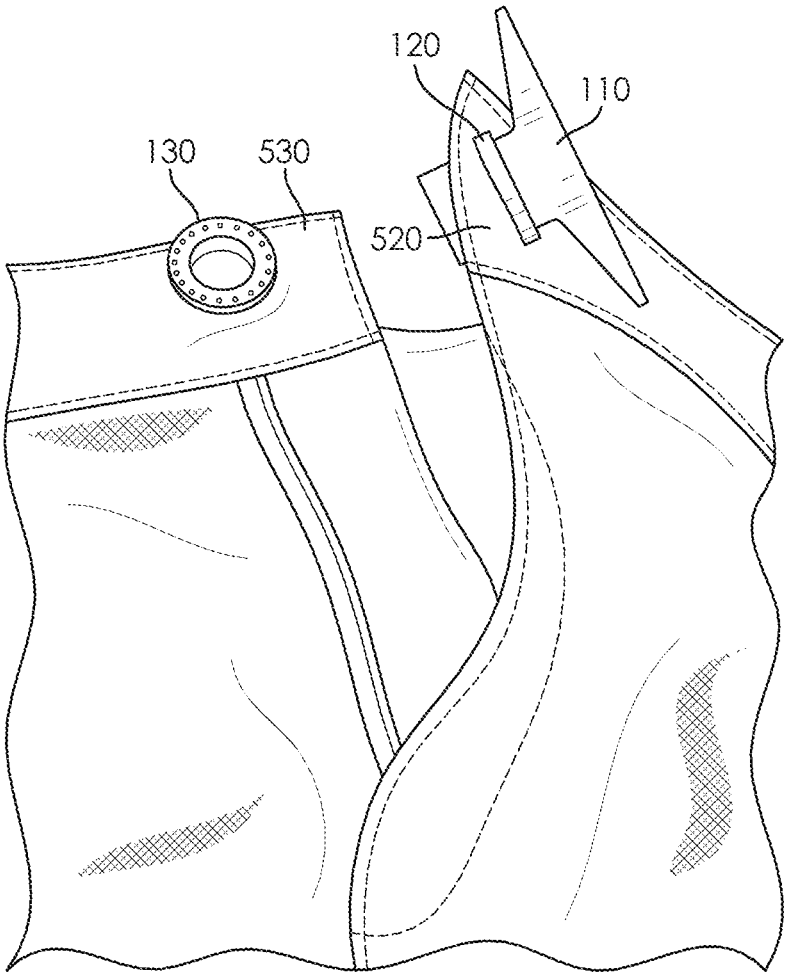
FIG. 5 shows a perspective view of an illustrative embodiment of a twist-lock button in use on a pair of pants, in accordance with an embodiment of the present invention.

FIG. 5 shows an embodiment of the present invention as it would be utilized. In FIG. 5, the negative 130 is attached to the rear fly 530 of a pair of pants, while the collar 120 is attached to the front fly 520 of the pair of pants. The handle 110 is retained in collar 120. When the locking portion of the handle 110 is engaged with the negative 130, the fly of the pants will be securely fastened.

Alternate Embodiments

Figure 6:
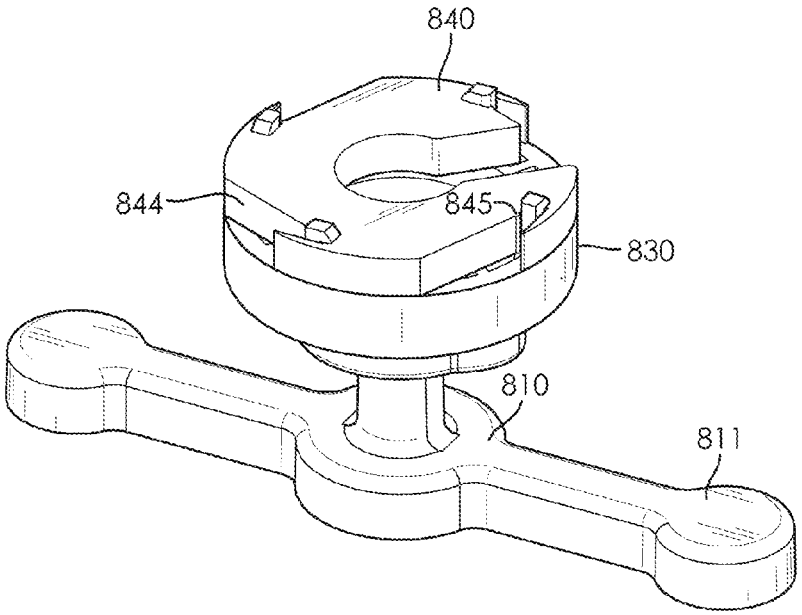
FIG. 6 shows a perspective view of a twist-lock button with a button adapter for attaching to an existing button according to one embodiment of the present invention.
Figure 7:
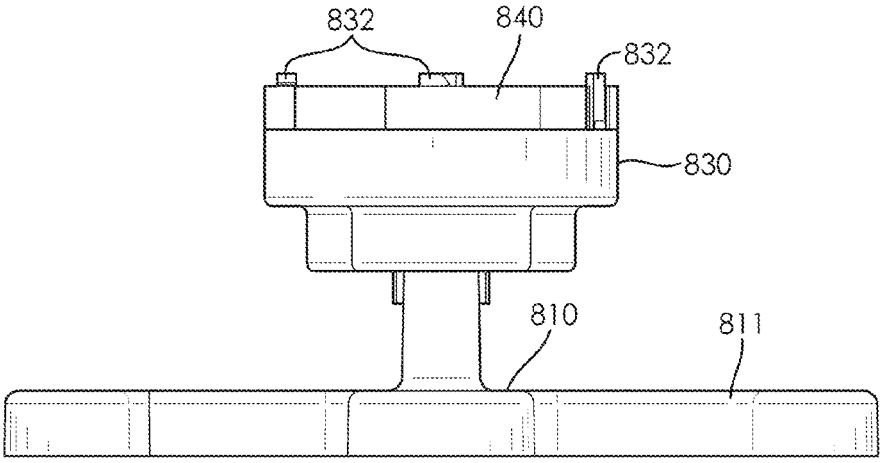
FIG. 7 shows a side profile view of a twist-lock button with a button adapter for attaching to an existing button according to one embodiment of the present invention.
Figure 8:
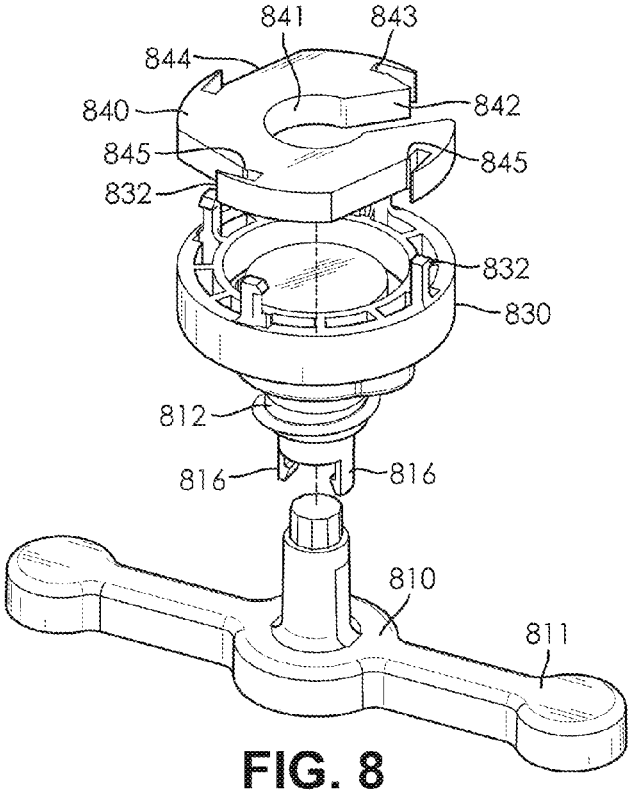
FIG. 8 shows an exploded perspective view of a twist-lock button with a button adapter for attaching to an existing button according to one embodiment of the present invention.
Figure 9:
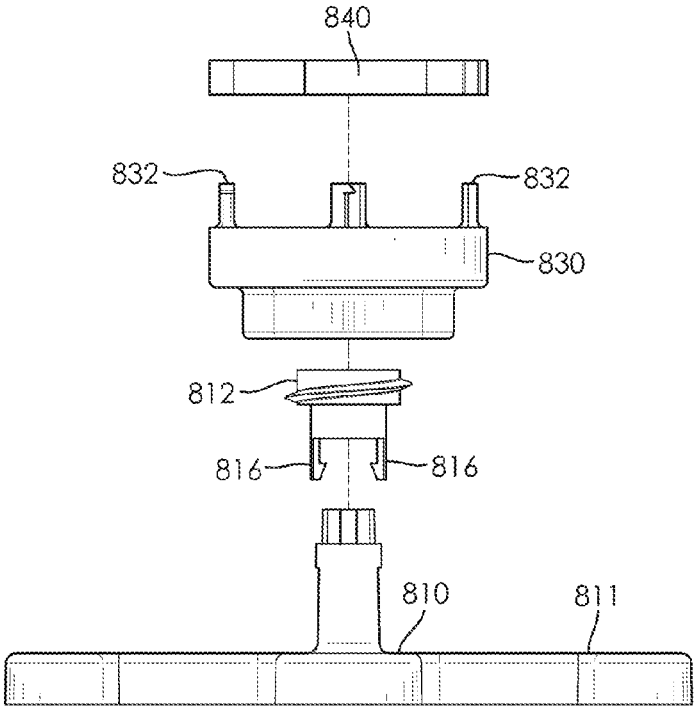
FIG. 9 shows an exploded side view of a twist-lock button with a button adapter for attaching to an existing button according to one embodiment of the present invention.

FIG. 6 shows a perspective view of a preferred embodiment of the present invention. FIG. 7 shows a side profile view of an embodiment of the present invention. FIG. 8 shows an exploded view of the same embodiment of the present invention. The features of this alternate embodiment will be explained with reference to FIG. 8. The same features are also labelled in FIGS. 6, 7, and 9, where visible. Moving from bottom to top, FIG. 8 shows a handle 810 with a grip portion 811, a locking portion 812, a receiver 830, and a button adaptor clip 840. The collar 120 is notably absent from this embodiment of the invention. This is because this embodiment uses the existing button and button hole of the article of clothing or equipment. The locking portion attached to the handle passes through a button hole and engages with the negative by a twisting 180 degrees. The negative attaches, using a button adapter clip, to a button that corresponds to the button hole. This embodiment is explained in more detail below.

According to the embodiment shown in FIG. 8, the first part is the handle 810, the second part is the locking portion 812, the third part is the receiver 830, and the fourth part is the button adapter clip 840. The button adapter clip 840, slides under a button between the button and the article it is attached to and interfaces with the receiver 830 to attach to the button.

According to an embodiment of the present invention, the locking portion 812 is a separate piece from the handle, rather than being a single piece as in FIGS. 1-5. The locking portion 812 snaps onto the handle 110 assembly by two or more locking hooks 816 extending from the end of the locking portion 812. The locking portion 812 and handle 810 are configured to mate securely together so that the locking portion 812 and handle 810 cannot rotate relative to each other and torque applied to the handle 810 is effectively transferred to the locking portion 812 to engage it with the negative 130.

In FIG. 8, the negative 130 comprises two components: a receiver 830, which receives the locking portion 812 in the same manner as the negative 130, and a button adapter clip 840. Together, the receiver 830 and the button adaptor clip 840 allow the receiver 830 to hold onto a button of a garment or other article, providing an alternate means of attaching the negative 130 or receiver 830 to a garment or other article.

The button adapter clip 840 is a plate with a center opening 841 and a side channel 842 that extends from the center opening 841 all the way to one outside edge. The side channel 842 provides a pathway for the attachment means between a button and an article of clothing to pass through the side channel 842 into the center opening 841 of the button adapter clip 840. This allows the button adapter clip 840 to slip under existing buttons and hold the button roughly at its center with the button adapter clip 840 lying between the bottom side of the button and the top side of the article it is attached to. The receiver 830 then fits over the top of the button and a plurality of locking hooks 832 engage with hook channels 843 on the button adapter clip, securely encapsulating the button and attaching the receiver 830 to a garment through the existing button.

According to an embodiment of the present invention, the hook channels 843 are holes which pass through the plate without a passage to an outside edge of the plate. In this case, the locking hooks 832 pass straight through the plate and either rotate into the locked position or snap into the locked position.

According to an embodiment of the present invention, an access passage 844 runs from the outer edge of the plate into each of the hook channels 843. The locking hooks 832 pass along the access passage 844 into the locking channels 843 by a twisting or rotating motion, such that the hooks slide into the hook channels 843 and are retained by the body of the plate. One of ordinary skill in the art would recognize that the locking hooks may be oriented in any direction and the hook channels sized and positioned appropriately to provide for rotation or snapping into the locked position as desired.

According to an embodiment of the present invention, a retaining nub 845 is positioned where the access passage 844 meets the locking channel 843. The retaining nub slightly narrows the opening where the access passage 844 meets the locking channel 843 so that the locking hooks 832 are prevented from slipping out of the locked position by rotation of the button adapter clip 840 relative to the receiver 830. The locking hooks 832 rotate and snap into the locked position as they slide over the retaining nub.

It is possible to take one or more features of the alternate embodiment of FIGS. 6-8 and incorporate it into the invention described in FIGS. 1-4. For example, a twist-lock button of FIGS. 1-4 could have a multi-piece negative 130 comprising a receiver 830 and a button adapter clip 840. One of ordinary skill in the art would recognize that there are a variety of ways to mix and match the components of FIGS. 1-4 with those of FIGS. 6-9 without departing from the spirit and scope of the present invention.

Figure 10:
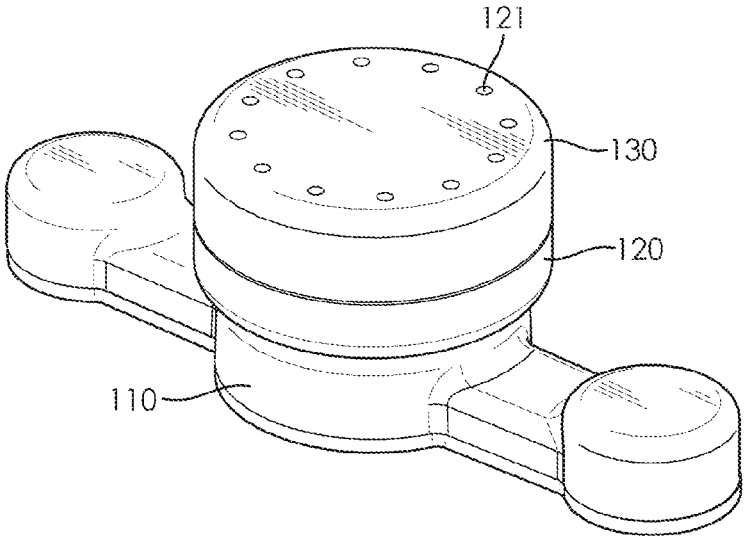
FIG. 10 is a perspective view of a twist-lock button in the locked state according to one embodiment of the present invention.
Figure 11:
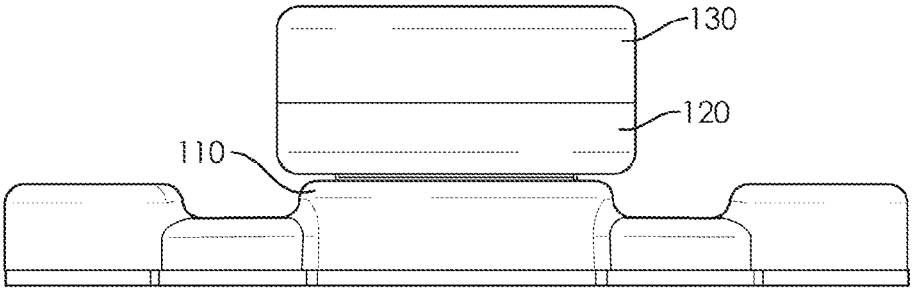
FIG. 11 is a side view of a twist-lock button in the locked state according to one embodiment of the present invention.
Figure 12:
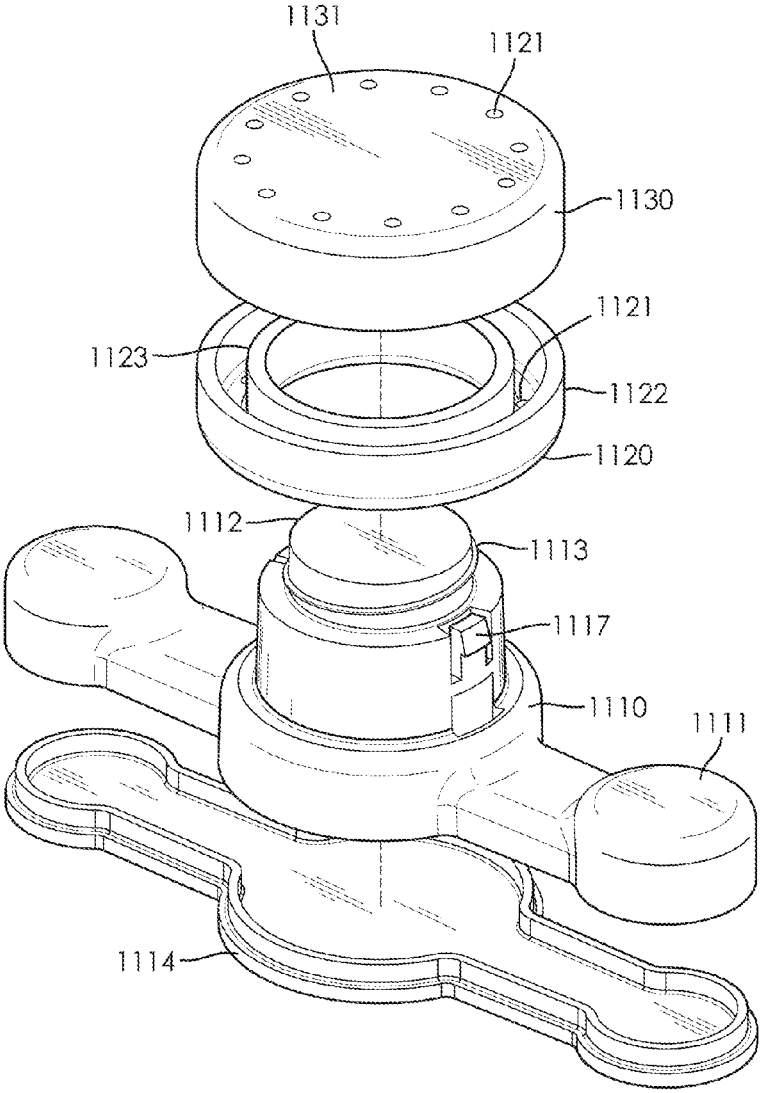
FIG. 12 shows an exploded perspective view of a twist-lock button according to one embodiment of the present invention.
Figure 13:
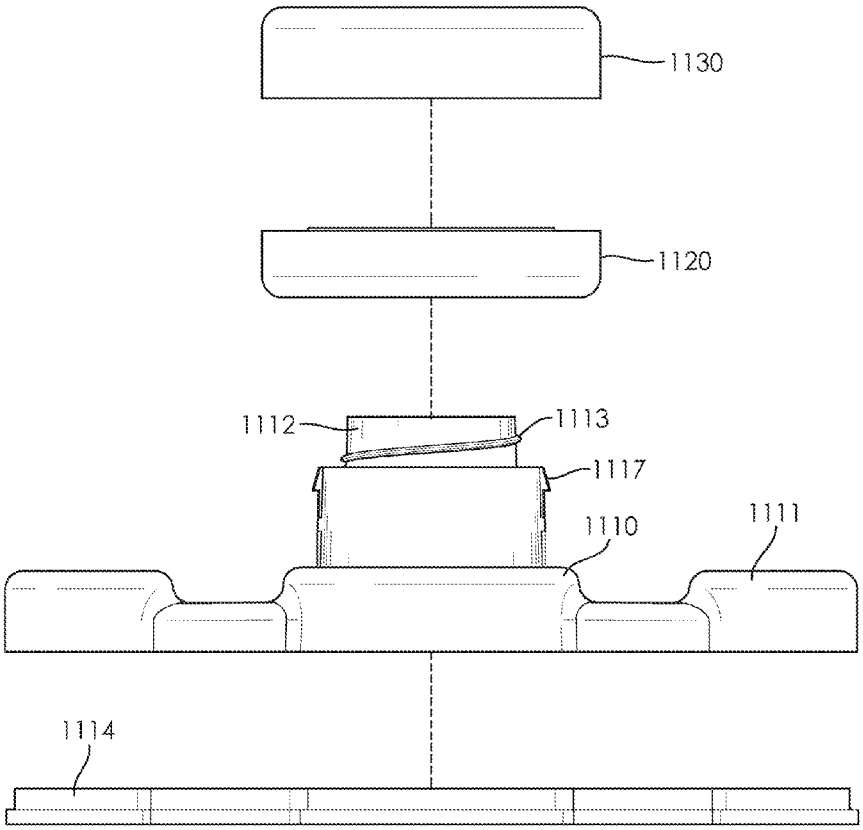
FIG. 13 shows an exploded side view of a twist-lock button according to one embodiment of the present invention.

Another alternate embodiment of the present invention is described with reference to FIGS. 10-13. FIG. 10 is a perspective view of an alternate embodiment of a twist-lock button in the locked state. FIG. 11 is a side view of the same embodiment of a twist-lock button in the locked state. FIG. 12 shows an exploded perspective view of the same embodiment of the invention in the unlocked state, and FIG. 13 show and exploded side view. The negative 1130 and collar 1120 shown in FIG. 12 are similar to the negative 130 and collar 120 of FIGS. 1-4, except they do not have a horizontal ridge with thread holes 121. Instead, the thread holes 1121 pass through the main body of the negative 1130 and collar 1120. The collar 1120 is formed of a substantially flat base circle with an outer sidewall 1122 rising from the outer perimeter and an inner sidewall 1123 rising from the inner perimeter. The outer sidewall 1122 and inner sidewall 1123 form a u-shaped circular perimeter channel or gap between them. At the bottom of this perimeter channel, the thread holes 1121 pass through the base circle, and the threads are protected from direct contact with moving parts or sources of abrasion. The inner sidewall 1123 forms a hole through which the handle 1110 and locking portion 1112 pass to engage and lock with the negative 1130.

The negative 1130 is similar in shape to the collar 1120, except the base is formed of a circular base disc 1131 without a hole passing through the center. Not shown in FIG. 12 is the mechanism on the negative 1130 for engaging with the locking portion 1112 of the handle 1110. This mechanism is explained in detail with reference to FIG. 3 earlier in the specification. In an alternate embodiment, the negative 1130 could have a hole passing through in similar fashion to the collar 1120. This hole would allow for the locking portion 1112 to pass through the negative 1130 so that the end of the locking portion 1112 is flush with the circular base disc (which would be a ring of material in this case) of the negative 1130, allowing for a slightly more compact twist-lock button when in the locked position and reducing the amount of material required to manufacture the negative 1130. In another alternate embodiment, the gap between the inner cavity (not shown in FIG. 12) and outer sidewall of the negative 1130 is filled with material, and the thread holes 1121 pass through the full thickness of the negative 1130. This would provide additional strength and prevent flex that could cause the locking portion 1112 to disengage from the negative 1130. One of ordinary skill in the art would recognize that many details of both the negative and the collar could be modified or combined without departing from the spirit and scope of the present invention.

According to an embodiment of the present invention depicted in FIG. 12, the handle 1110 has a plurality of locking tabs 1117 which snap into the collar 1120 securing the handle 1110 and collar 1120 together while allowing the handle 1110 to rotate freely relative to the collar 1120. According to an embodiments of the present invention, the handle 1110 may comprise a grip portion 1111, and a lid 1114. When put together, the grip portion 1111 and the lid 1114 form the handle 1110 assembly. In certain embodiments, the grip portion 1111 and lid 1114 may be one integrated piece, while in other embodiments, grip portion 1111 and lid 1114 may be separate but combinable components.

According to an embodiment of the present invention, the lid 1114 is an ideal location for the placement of branding materials, such as logos, product indicators, icons or other indicators of source or association. In certain embodiments, the branding materials may be incorporated into the lid 1114. In other embodiments, the branding materials may be attached or otherwise secured to the lid 1114, such as via an adhesive or other affixing means. One of ordinary skill in the art would appreciate that there are numerous types of adhesives or affixing means that could be utilized with embodiments of the present invention, and embodiments of the present invention are contemplated for use with any appropriate adhesive or affixing means.

Figure 14:
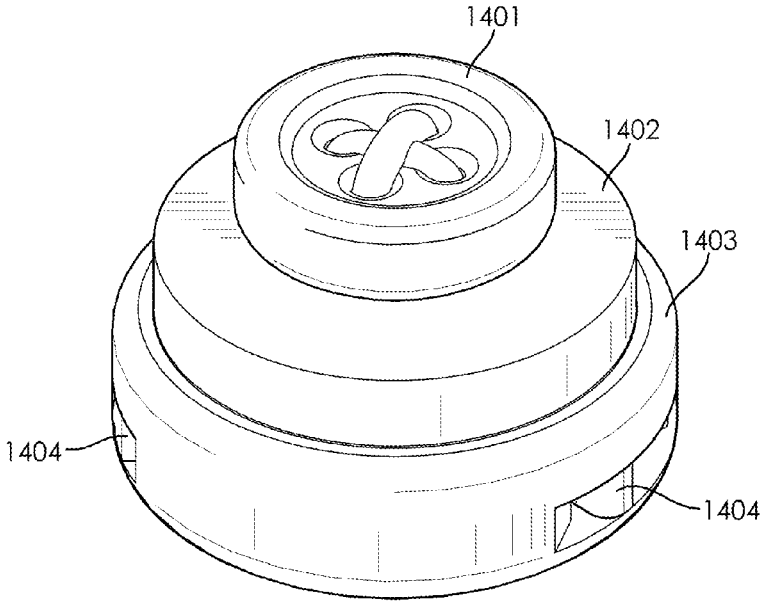
FIG. 14 shows a perspective view of an embodiment of a magnetic button adapter with all the parts connected together
Figure 15:
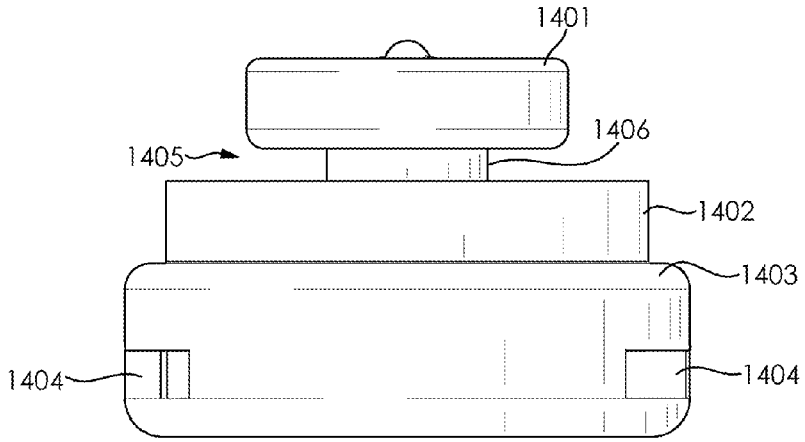
FIG. 15 shows a side view of an embodiment of a magnetic button adapter with all the parts connected together.

According to an embodiment of the present invention illustrated in FIGS. 14-21, a magnetic fastening system is used rather than a twist-lock. While these figures show these embodiments being utilized separately, certain embodiments are contemplated that utilize both magnetic and twist-lock fasteners together. FIGS. 14-15 show the magnetic fastening system with all the parts assembled and connected together. Referring to FIGS. 14-15, in the magnetic system, the first part is a retaining piece 1401 such as a button or snap instead of a handle. The second part is a magnetic fastener piece 1402 which attaches to the retaining piece 1401 through a buttonhole, securing the magnetic fastener piece 1402 to an article. The magnetic fastener piece 1402 may be a magnet or a piece of magnetic material. The magnetic fastener piece 1402 and the retaining piece 1401 together compose the first magnetic portion. Although the retaining piece 1401 is decorative, it also serves a function of holding the magnetic fastener piece 1402 to the article.

According to an embodiment of the present invention shown in FIG. 15, the magnetic fastener piece 1402 and the retaining piece 1401 are connected to each other by a connecting rod 1406 that leaves a gap 1405 between the bottom surface of the retaining piece 1401 and the top surface of the magnetic fastener piece 1402. This gap 1405 allows fabric or some other material to fit between the retaining piece 1401 and the magnetic fastener piece 1402 when they are attached to the article.

According to an embodiment of the present invention, the third piece is a magnetic receiving piece 1403. The magnetic receiving piece 1403 is either a magnet or a piece of magnetic material. At least one of the magnetic fastener piece 1402 and the magnetic receiving piece 1403 must be a magnet; the other piece may be either a magnet or a piece of magnetic material. According to one embodiment, the magnetic receiving piece 1403 attaches directly to an article through any appropriate securing or retention means, such as riveting, sewing, tacking, adhesives, or any combination thereof. According to another embodiment, the magnetic receiving piece attaches to a button already attached to an article, as shown in FIGS. 14-18.

According to an embodiment of the present invention, a fourth piece is a button adapter clip 1404. In FIGS. 14-15, this button adapter clip 1404 is a clip which slides into the magnetic receiving piece and under a button inside a button cavity 1604 (shown in FIG. 16) of the magnetic receiving portion. One embodiment of the button adapter is described in more detail with reference to FIGS. 16-18.

Figure 16:
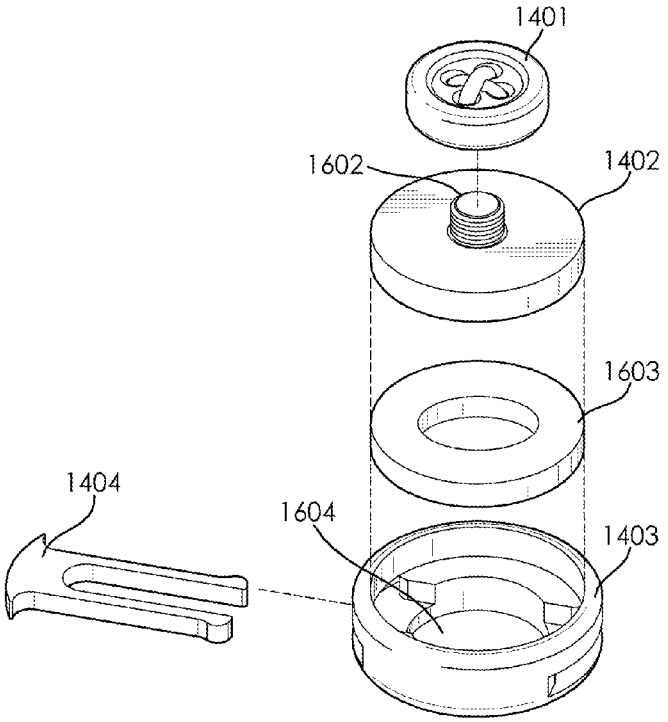
FIG. 16 shows an exploded perspective view of a magnetic button adapter showing how the individual parts fit together, including the clip that slides into the second magnetic portion which attaches to a button.
Figure 17:
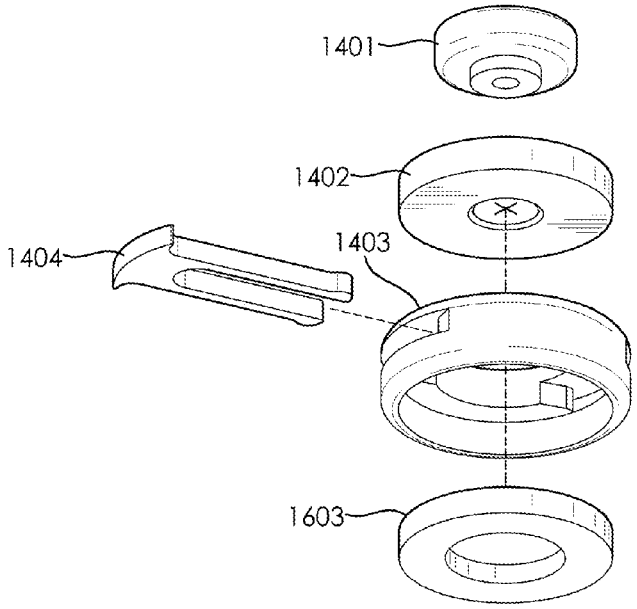
FIG. 17 shows an exploded side view of a magnetic button adapter showing how the individual parts fit together, including the clip that slides into the second magnetic portion which attaches to a button.

Referring now to FIGS. 16-17, according to one embodiment of the present invention, the retaining piece 1401 attaches to the magnetic fastener piece 1402 by an attachment bolt 1602 integrated into the magnetic fastener piece 1402. Alternatively, the attachment bolt 1602 passes through the magnetic fastener piece 1402 and into the retaining piece 1401 (shown in FIG. 18). According to yet another embodiment of the present invention, the magnetic fastener piece 1402 and retaining piece 1401 are integrally formed from a single piece of magnetic material, welded together, or otherwise permanently attached to each other by a connecting shaft 1406 to form the first magnetic portion. The first magnetic portion then attaches to the article by inserting the retaining piece 1401 through a button hole just as one would with a button. The material of the connecting shaft 1406 is not important and can be any material as long as the magnetic fastener piece 1402 is a magnetic material. One or ordinary skill in the art would recognize that any means of attaching the retaining piece 1401 to the magnetic fastener piece 1402 could be used without departing from the spirit and scope of the present invention.

According to an embodiment of the present invention, the magnetic insert 1603 is an annular ring placed into the magnetic receiving piece 1403. This allows the magnetic receiving piece 1403 to be made from plastic or some other non-magnetic material which is easier to work with and form into more complex shapes than magnets or metal. The hole in the center of the magnetic insert is sized to allow a button to be placed within the center of the magnetic insert 1603 when the magnetic receiving piece is attached to a button. The magnetic insert 1603 may be a magnet or a piece of magnetic material.

According to one illustrative embodiment, the retaining piece 1401 and magnetic fastener piece 1402 are integrally formed, machined together from a single piece of stainless steel. The magnetic insert is a high strength neodymium magnet which snaps into the magnetic receiving piece 1403, which is made from injection molded plastic. The button adapter clip 1404 is a clip also formed of plastic. After a button attached to an article is inserted into the button cavity 1604 of the magnetic receiving piece 1403, the button adapter clip 1404 slides into the magnetic receiving piece 1403 and under the button, snapping into the opposite end of the magnetic receiving piece 1403 and trapping the button inside the magnetic receiving piece 1403. The retaining piece 1401 is inserted through a button hole that corresponds to the button inside the magnetic receiving piece 1403. In embodiments where the magnetic receiving piece 1403 receives a magnetic insert 1603, the magnetic receiving piece need not be magnetic itself. In embodiments where the magnetic insert 1603 is integrated into magnetic receiving piece 1403, forming a single unit referred to as the magnetic receiving piece 1403, it should be made of a magnetic material and may itself be a magnet.

FIG. 17 shows an alternate embodiment where the magnetic receiving piece 1403 and the magnetic insert 1603 switch positions. The magnetic receiving piece 1403 is also flipped over (relative to FIG. 16) so that when the entire system is assembled, the button adapter clip 1404 sits between the magnetic fastener piece 1402 and the magnetic insert 1603. In this embodiment, the button that the magnetic fastener system attaches to passes through the magnetic insert 1603 and is held in place within the magnetic receiving piece 1403 by the button adapter clip 1404. Alternatively, the magnetic insert 1603 sits deeper within the magnetic receiving piece 1403 between the button adapter clip and the magnetic fastener piece 1402. In this embodiment the button is held within the center hole of the annular magnetic insert 1603 by the button adapter clip 1404.

The magnetic fastening piece 1402 shown in FIG. 17 has a screw head integrated into the center to facilitate screwing the magnetic fastening piece 1402 into the retaining piece 1401. When the attachment bolt 1602 with bolt threading is integrated into the magnetic fastening piece 1402, this screw head is optional since the magnetic fastening piece 1402 itself can be used to screw the attachment bolt 1602 into the retaining piece 1401. The attachment bolt in FIGS. 16-18 and connecting rod in FIGS. 14-15 may alternatively employ different connection mechanisms, including a retaining ledge, a lip, a ramp, a snap, clip, glue, welding, or any attachment mechanism that is suitable. One of ordinary skill in the art would recognize that any attachment mechanism could be used to connect the retaining piece 1401 to the magnetic fastener piece 1402 by a connecting rod without departing from the spirit and scope of the present invention.

Figure 18:
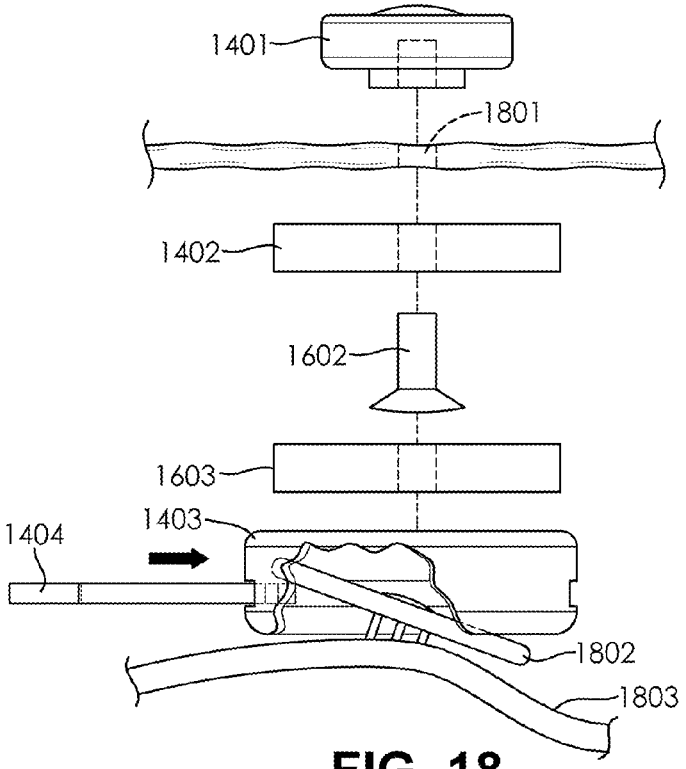
FIG. 18 is a side view showing how the first magnetic portion attaches to an article through a button hole and the second magnetic portion attaches to an article by a button attached to the article. The second magnetic portion attaches to a button by fitting around the button and a clip slides into the second portion between the button and the article the button is attached to. The first and second magnetic portions attach to each other magnetically.

FIG. 18 shows how the magnetic fastening system attaches to a button and a button hole. An attachment bolt 1602 passes through the magnetic fastener piece 1402, through a button hole 1801 of an article and fastens to the retaining piece 1401, securing the retaining piece 1401 and magnetic fastener piece 1402 to the article. A button 1802 attached to an article 1803 fits inside a button cavity of the magnetic receiving piece 1403 and the button adapter clip 1404 slides into the magnetic receiving piece 1403, underneath the button 1802, and snaps into the opposite end of the magnetic receiving piece 1403, securing the button inside the magnetic receiving piece 1403 and securing the magnetic receiving piece 1403 to the article 1803.

Figure 19:
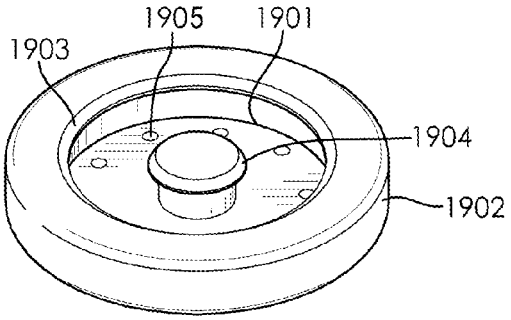
FIG. 19 shows a perspective view of a magnet attachment mechanism.
Figure 20:
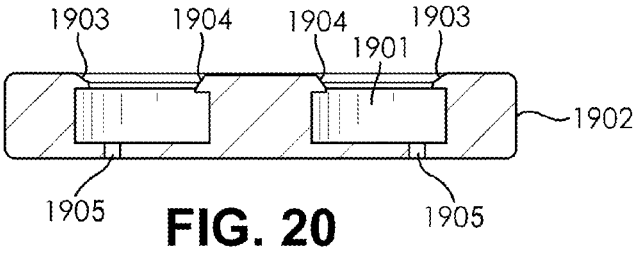
FIG. 20 shows a cross-sectional side view of a magnet attachment.

FIGS. 19-20 show an embodiment of a magnetic insert attachment mechanism to be incorporated into the magnetic receiving piece 1403 according to an embodiment of the present invention. A circular cavity 1901 is configured to receive a circular magnetic insert 1603. The sidewalls 1902 are configured to rise slightly above the surface of the magnetic insert 1603. An outer ridge 1903 at the outer edge of the circular cavity 1901 forms a lip that overhangs the edge of the magnetic insert 1603 when inserted into the attachment mechanism. Pushing the magnetic insert 1603 into the circular cavity 1901 causes it to snap into the circular cavity 1901, so that the outer ridge 1903 holds the magnetic insert 1603 in place. This magnetic insert attachment mechanism can be directly attached to an article by using the thread holes 1905 or any other appropriate means.

According to one embodiment, the circular cavity 1901 forms a ring with an inner ridge 1904 that operates in the same manner as the outer ridge, snapping onto a hole in the center of the magnetic insert 1603. The inner ridge 1904 may be used in combination with the outer ridge 1903, or either the inner ridge 1904 or the outer ridge 1903 may be used alone. The inner ridge 1904 may be used when the magnetic insert 1603 forms an annular ring. When the magnetic insert forms an annular ring, either the inner ridge embodiment, the outer ridge embodiment, or the embodiment with both inner and outer ridges may be used to secure the magnetic insert 1603 to the magnetic receiving piece 1403.

The magnetic insert attachment mechanism may be integrally formed into the top of the magnetic receiving piece 1403. According to another embodiment, the magnetic insert may be glued, welded, or otherwise fastened to the top of the magnetic receiving piece 1403. In yet another embodiment, the magnetic receiving piece 1403 may be formed entirely of magnetic material, with a top end configured to interface with the magnetic fastener piece 1402. One of ordinary skill in the art would recognize that a variety of configurations of the magnetic receiving piece could be used without departing from the spirit and scope of the present invention.

Figure 21:
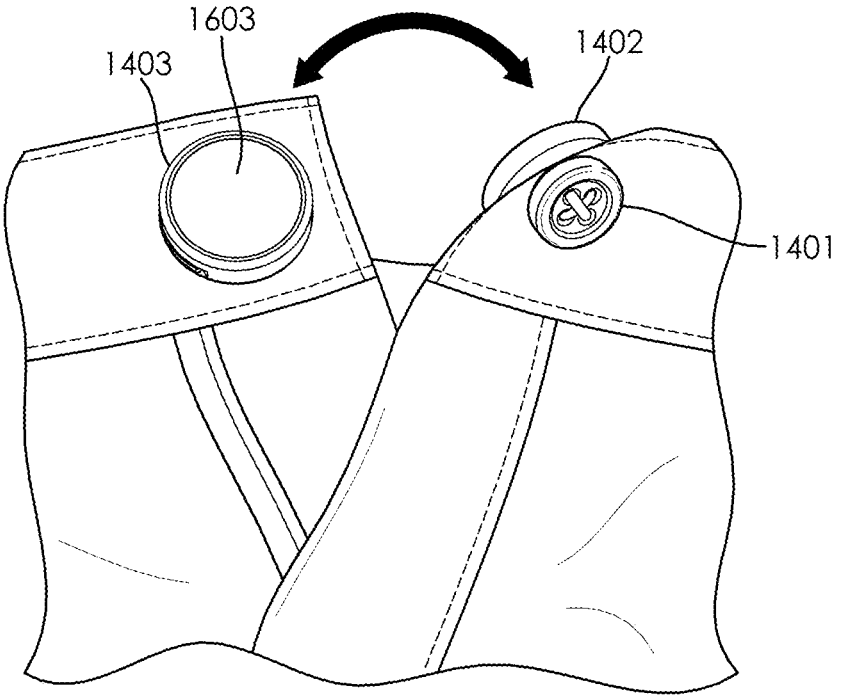
FIG. 21 shows a view of a magnetic button adapter where each magnetic portion is attached to a button hole or button of an article, but the magnetic portions are not attached to each other.

FIG. 21 shows the magnetic fastening system attached to an article of clothing according to an embodiment of the present invention. The retaining piece 1401 is attached to the magnetic fastener piece 1402 by a connecting shaft or bolt that passes through a button hole on the fly of a pair of pants. The magnetic receiving piece 1403 is attached to the button on the other side of the fly. The magnetic insert 1603 is held inside the magnetic receiving piece 1403. According to one embodiment of the present invention, the magnetic insert 1603 and the magnetic fastener piece 1403 are magnets. According to another embodiment of the present invention, one of the magnetic insert 1603 and the magnetic fastener piece 1403 is a piece of magnetic material and the other is a magnet.

Figure 22:
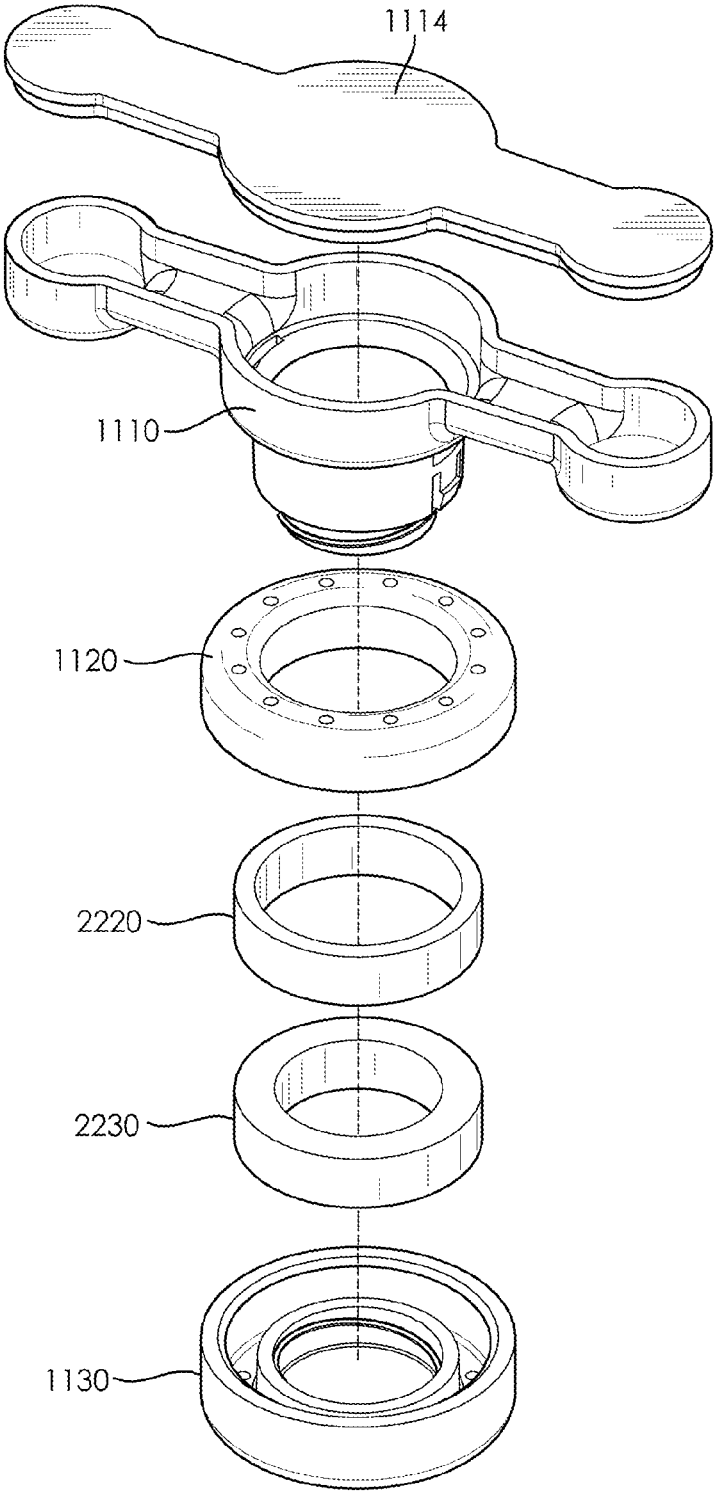
FIG. 22 shows a view of a twist-lock fastener that combines certain elements of the magnetic fastener to improve usability.
Figure 23:
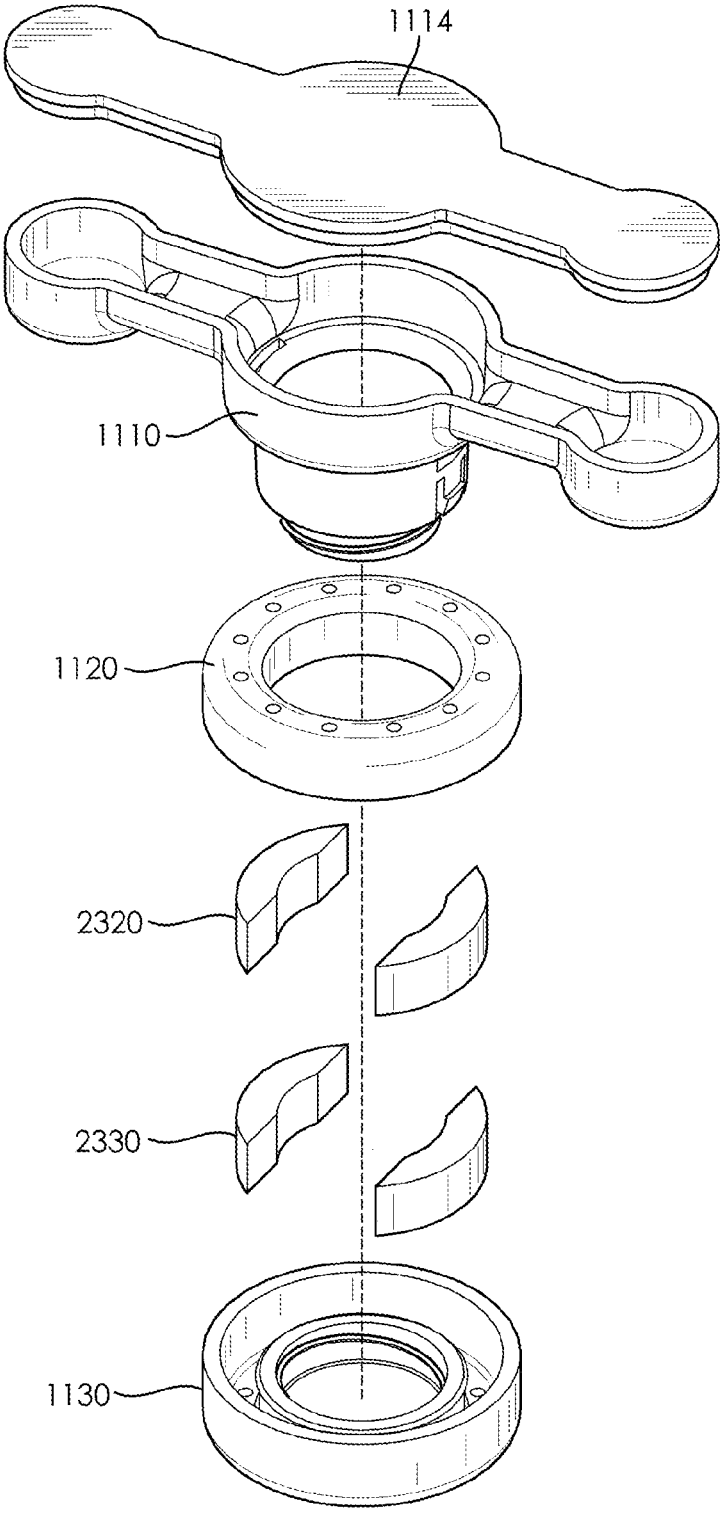
FIG. 23 shows a view of a twist-lock fastener that combines certain elements of the magnetic fastener to improve usability.

FIGS. 22-23 show a twist-lock fastener that combines certain elements of the magnetic fastener to improve usability. FIG. 22 shows an annular magnetic fastener piece 2220 that fits into the collar 1120 and a magnetic insert 2230 that fits into the negative 1130. These magnetic pieces help to align the collar with the negative so that the user does not have to align the pieces manually. In on illustrative embodiment, the magnetic fastener piece 2220 and magnetic insert 2230 are both magnets. This helps to produce better alignment than having one or the other of the pieces magnetic, but not itself a magnet. According to an embodiment of the present invention shown in FIG. 22, the magnetic fastener pieces 2320 and magnetic insert 2330 may snap into the collar 1120 and negative 1130 respectively. A retaining lip on the inside of the outer wall of both the collar 1120 and the negative 1130 retains the magnetic fastener pieces 2320 and the magnetic inserts 2330 within the collar 1120 and negative 1130 respectively.

In FIG. 23, the magnetic fastener piece 2320 comprises two or more pieces and the magnetic insert 2330 comprises two or more pieces. These pieces are smaller, lighter weight, and use less magnetic material than FIG. 22, and serve the same purpose as the magnetic fastener piece 2220 and magnetic insert 2230 in FIG. 21. According to an embodiment of the present invention shown in FIG. 23, the magnetic fastener pieces 2320 and magnetic insert 2330 may snap into the collar 1120 and negative 1130 respectively. A retaining lip on the outside of the inner wall of both the collar 1120 and the negative 1130 retains the magnetic fastener pieces 2320 and the magnetic inserts 2330 within the collar 1120 and negative 1130 respectively. One of ordinary skill in the art would recognize that the magnetic fastener pieces 2220, 2320 and magnetic inserts 2230, 2330 may attach to the collar and negative by other attachment means, including glue, welding, clips, or any other attachment means without departing from the spirit and scope of the present invention.

Figure 24:
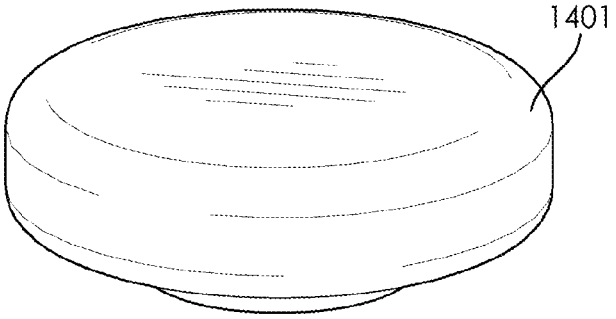
FIG. 24 shows a perspective view of a retaining piece for use with a button adapter, in accordance with an embodiment of the present invention.
Figure 25:
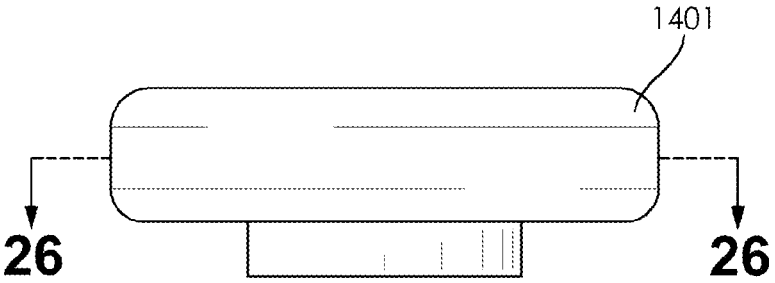
FIG. 25 shows a side view of a retaining piece for use with a button adapter, in accordance with an embodiment of the present invention.
Figure 26:
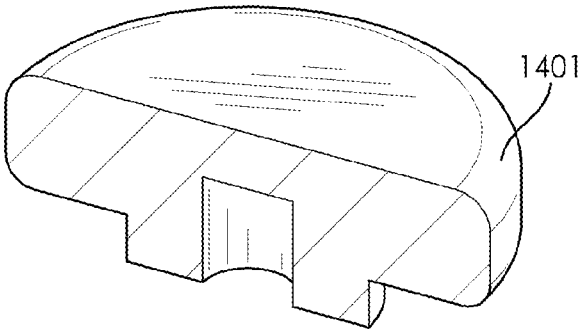
FIG. 26 shows a sectional view of a retaining piece for use with a button adapter, in accordance with an embodiment of the present invention.

Turning now to FIGS. 24-26, an exemplary embodiment of a retaining piece 1401 is shown. These exemplary embodiments show a retaining piece 1401 that has a slightly wider diameter than a standard retaining piece. The extra width makes the retaining piece 1401 ideal for inclusion of graphics or texts, such as graphics licensed from sports teams. Preferred embodiments of such retaining pieces could be used on articles of clothing, such as "coaches jacket" style outerwear. Other embodiments of this type of retaining piece may be used on other articles, as described in detail herein.

It should be noted that magnetic material may be stainless steel, iron, or any other magnetic metal, or a magnetic polymer or rare earth element. The material that makes up the magnetic components (magnetic fastener piece 1402 and magnetic insert 1603) is not important, but at least one of the magnetic components 1402, 1603 must be a magnet and the other can be either a magnet or made of any magnetic material or conductive metal.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A fastening system for augmenting a button and button hole fastener, said fastening system comprising:

a retaining piece;

a first fastening part configured to attach to the retaining piece by a connecting shaft, said connecting shaft configured to pass through a hole in an article;

a second fastening part configured to attach to a button sewn to an article; wherein said second fastening part further comprises:

a main body portion comprising a cavity configured to fit onto a button, and an access slot passing through at least one side of the main body portion into the cavity; and a button adapter clip configured to slide into the access slot and under a button inside the cavity;

wherein said first fastening part and said second fastening part are configured to be removably attachable to each other;

wherein said first fastening part comprises a magnet.

2. The fastening system of claim 1 wherein said second fastening part comprises a magnetic insert attached to the second fastening part by a magnetic insert attachment mechanism.

3. The fastening system of claim 1 wherein said first fastening part attaches to said retaining piece by means of a bolt which forms the connecting shaft.

4. A fastening system for augmenting a button and button hole fastener, said fastening system comprising:

a retaining piece;

a first fastening part configured to attach to the retaining piece by a connecting shaft, said connecting shaft configured to pass through a hole in an article;

a second fastening part configured to attach to a button sewn to an article; wherein said second fastening part further comprises:

a main body portion comprising a cavity configured to fit onto a button, and an access slot passing through at least one side of the main body portion into the cavity; and a button adapter clip configured to slide into the access slot and under a button inside the cavity;

wherein said first fastening part and said second fastening part are configured to be removably attachable to each other;

wherein said second fastening part comprises a magnetic insert.

5. The fastening system of claim 4 wherein the magnetic insert is attached to the main body portion of the second fastening part.

* * * * *